US011368784B2

(12) United States Patent
Kim

(10) Patent No.: US 11,368,784 B2
(45) Date of Patent: Jun. 21, 2022

(54) RECEIVER UNIT HAVING PRESSURE EQUILIBRIUM STRUCTURE AND COMPENSATION STRUCTURE FOR LOW FREQUENCY

(71) Applicant: EM-TECH Co., Ltd., Gyeongsangnam-do (KR)

(72) Inventor: Yong Hue Kim, Gyeonggi-do (KR)

(73) Assignee: EM-TECH CO., LTD., Gyeongsangnam-Do (KR)

( * ) Notice: Subject to any disclaimer, the term of this patent is extended or adjusted under 35 U.S.C. 154(b) by 0 days.

(21) Appl. No.: 17/094,090

(22) Filed: Nov. 10, 2020

(65) Prior Publication Data

US 2021/0144462 A1 May 13, 2021

(30) Foreign Application Priority Data

Nov. 11, 2019 (KR) ..... 10-2019-0143349

(51) Int. Cl.
*H04R 1/28* (2006.01)
*H04R 1/10* (2006.01)

(52) U.S. Cl.
CPC ..... *H04R 1/1083* (2013.01); *H04R 1/1016* (2013.01)

(58) Field of Classification Search
CPC .. H04R 1/1016; H04R 1/1075; H04R 25/652; H04R 2225/025; H04R 2460/09; H04R 2460/11
See application file for complete search history.

(56) References Cited

U.S. PATENT DOCUMENTS

| | | | | |
|---|---|---|---|---|
| 6,738,487 | B1 * | 5/2004 | Nageno | H04R 1/1016 381/322 |
| 8,111,857 | B2 * | 2/2012 | Kuhtz | H04R 1/1016 381/372 |
| 8,885,866 | B2 * | 11/2014 | Sakaguchi | H04R 25/652 381/382 |
| 9,237,394 | B2 * | 1/2016 | Seo | H04R 1/1016 |
| 2019/0208301 | A1 * | 7/2019 | Monti | H04R 25/652 |
| 2020/0178003 | A1 * | 6/2020 | Zurbruegg | H04R 25/603 |
| 2021/0099791 | A1 * | 4/2021 | Grinker | H04R 1/2849 |
| 2021/0136478 | A1 * | 5/2021 | Jou | H04R 1/04 |
| 2021/0289279 | A1 * | 9/2021 | Ko | H04R 1/1016 |

FOREIGN PATENT DOCUMENTS

| | | | |
|---|---|---|---|
| KR | 101558091 | B1 | 10/2015 |
| KR | 101958257 | B1 | 7/2019 |

* cited by examiner

*Primary Examiner* — Ryan Robinson
(74) *Attorney, Agent, or Firm* — Murphy, Bilak & Homiller, PLLC

(57) ABSTRACT

Disclosed is a receiver unit having a pressure equilibrium structure and a compensation structure for a low frequency, including a receiver including a frame, a magnetic circuit, a voice coil, and a diaphragm, an upper casing covering an upper portion and a side surface of the receiver and having a sound insulation hole, and a lower casing attached to a lower surface of the receiver and coupled to the upper casing, wherein a ventilation recess is provided on an outer surface of the upper casing to allow air to flow between an upper space of the upper casing and a lower space of the lower casing, the receiver includes a back hole, and the lower casing includes a duct connecting the back hole and the lower space of the lower casing.

5 Claims, 4 Drawing Sheets

RECEIVER UNIT HAVING PRESSURE EQUILIBRIUM STRUCTURE AND COMPENSATION STRUCTURE FOR LOW FREQUENCY

TECHNICAL FIELD

The present disclosure relates to a receiver unit having a pressure equilibrium structure and a compensation structure for a low frequency.

BACKGROUND

Earphones are classified into a closed earphone in which the rest of the earphone is blocked except for a sound radiating hole inserted into an ear canal and an open earphone including a tuning hole and a duct in addition to the sound radiating hole.

The closed earphone, which transmits a sound of a receiver installed therein directly into a user's ear, enables the user to hear a sound even with small power, and in particular, a canal-type earphone inserted into the user's ear through an earpiece has the advantage of excellent sound insulation to block ambient noise.

However, in the case of a canal-type earphone, a difference in atmospheric pressure between the inside and outside of the ear canal occurs as an ear canal is completely sealed, and thus ears may become deaf or some people may feel uncomfortable. Korean Patent Registration No. 10-1558091 discloses a canal-type earphone including a pressure equilibrium means to improve the pressure difference.

FIG. 1 is a view showing a canal-type earphone including a pressure equilibrium means according to the related art. A canal-type earphone 1 according to the related art includes a speaker unit 10, a housing 20 accommodating the speaker unit 10, and an earpiece 23 installed on an outer surface of a tube 25 integrally formed on a front portion of the housing 20. The speaker unit 10 installed in the housing 20 includes a cylindrical frame 11, a magnetic circuit 15, 16 installed in the frame 11, and a diaphragm 13 that vibrates up and down by a magnetic force of the magnetic circuit 15, 16. The frame 11 has a cylindrical shape and includes a cover 18 installed at a front and a bracket 19 installed at a rear. A through hole 18*a* is provided at the center of the cover 18 to emit sound generated in the diaphragm 13 forward. In addition, a through hole 19*a* is provided at the center of the bracket 19 to discharge the sound generated in the diaphragm 13 to the rear. Further, a through hole 16*a* is provided at the center of a yoke 16 to emit the sound generated in the diaphragm 13 to the rear.

A gasket 30 is installed on a front surface of the cover 18. The gasket 30 is formed of an elastic material such as rubber or silicone. In addition, a through hole 30*a* is provided at the center of the gasket 30 to discharge sound emitted from the speaker unit 10.

A pressure equilibrium means for discharging air present at the front of the speaker unit 10 to the rear of the speaker unit 10 to eliminate a pressure difference between the user's ear canal and ambient air is provided. The pressure equilibrium means of the earphone according to the related art includes a side air passage 50 for discharging air inside A the tube 25 or air inside B the speaker unit 10 to a side surface C of the gasket 30 or a side surface D of the speaker unit 10 and a rear air passage 60 for discharging air on the side surface C of the gasket 30 or the side surface D of the speaker unit 10 to the rear E of the speaker unit 10.

However, in the case of the canal-type earphone, if the ear canal is not completely sealed when worn, a sound pressure inevitably decreases in a low frequency range. Therefore, development of a structure capable of compensating for a decrease in sound pressure in the low frequency range, while improving deafening of the canal-type earphone by providing an air passage is required.

SUMMARY

Therefore, an object of the present disclosure is to provide a receiver unit for a canal-type earphone, capable of compensating for a decrease in sound pressure in a low frequency range, while improving a difference in pressure between an ear canal and outside, when the canal-type earphone is worn.

According to an aspect of the present disclosure, there is provided a receiver unit having a pressure equilibrium structure and a compensation structure for a low frequency, including: a receiver including a frame, a magnetic circuit, a voice coil, and a diaphragm; an upper casing covering an upper portion and a side surface of the receiver and having a sound insulation hole; and a lower casing attached to a lower surface of the receiver and coupled to the upper casing, wherein a ventilation recess is provided on an outer surface of the upper casing to allow air to flow between an upper space of the upper casing and a lower space of the lower casing, the receiver includes a back hole, and the lower casing includes a duct connecting the back hole and the lower space of the lower casing.

In addition, as another example of the present invention, the receiver unit may further include: at least one acoustic mesh located in a duct path and compensating for a reduction in a low frequency.

In addition, as another example of the present invention, the acoustic mesh may be attached to cover the back hole of the receiver, and the acoustic mesh may be accommodated in a duct of the lower casing.

In addition, as another example of the present invention, the acoustic mesh may be attached to a lower surface of the lower casing to cover an end of the duct.

In addition, as another example of the present invention, the ventilation recess may be provided on at least one of an upper surface and a side surface of the upper casing.

In addition, as another example of the present invention, a depth and a width of the ventilation recess may be adjusted as necessary.

In the receiver unit provided by the present invention, pressure equilibrium is made between inside and outside an ear canal by forming the ventilation recess on the upper casing, and the duct provided at the lower casing and the acoustic mesh applied to the receiver unit may prevent complete sealing when applied to the canal-type earphone, thereby compensating for a reduction in sound pressure in a low frequency range.

Those skilled in the art will recognize additional features and advantages upon reading the following detailed description, and upon viewing the accompanying drawings.

DETAILED DESCRIPTION

Hereinafter, the present disclosure will be described in more detail with reference to the drawings.

Figure 1:
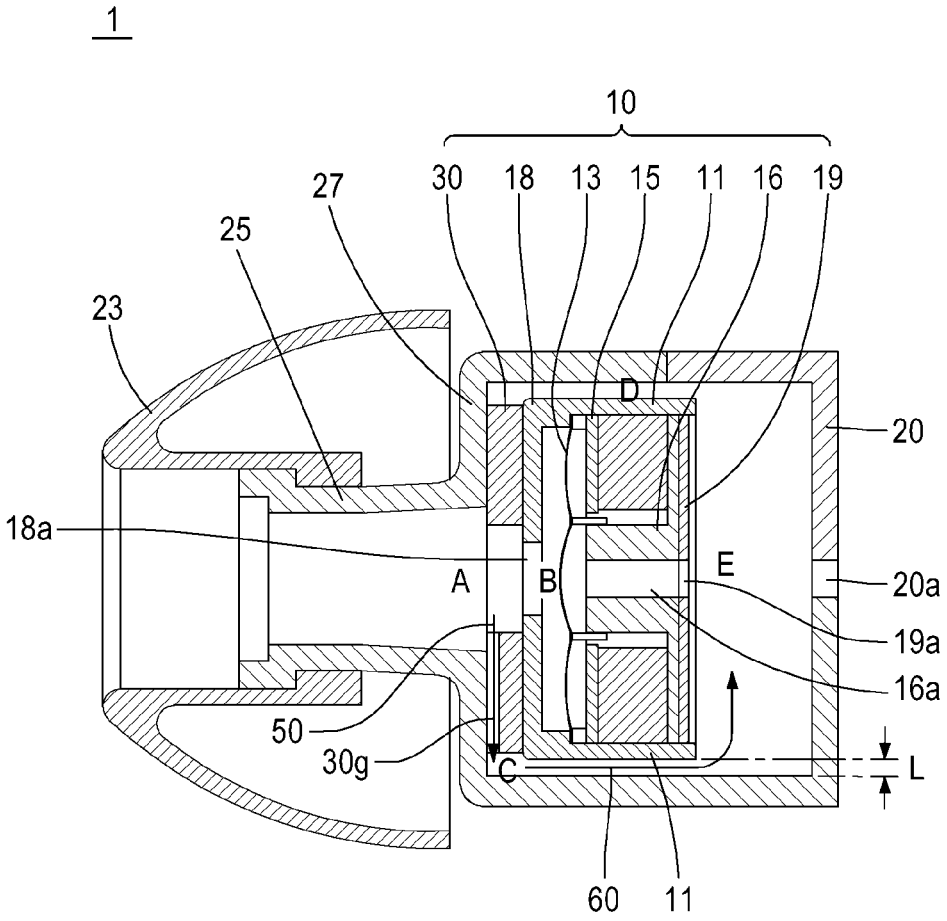
FIG. 1 is a view showing a canal-type earphone including a pressure equilibrium means according to the related art.
Figure 2:
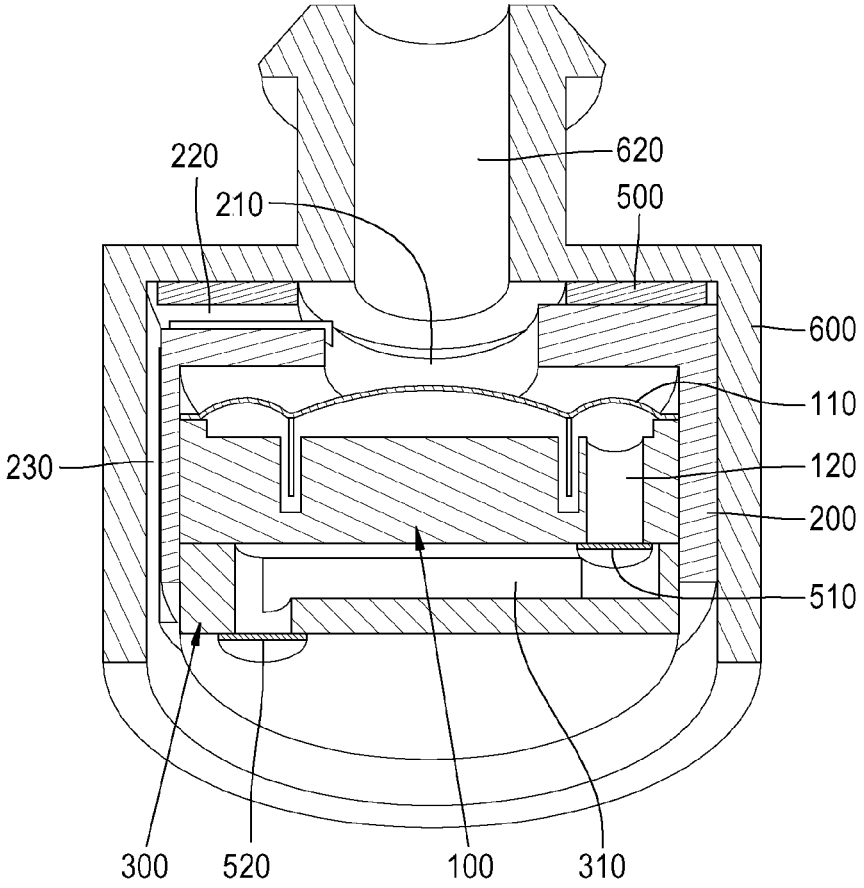
FIG. 2 is a cross-sectional view of a receiver unit having a pressure equilibrium structure and a compensation structure for low frequency according to an embodiment of the present invention.
Figure 3:
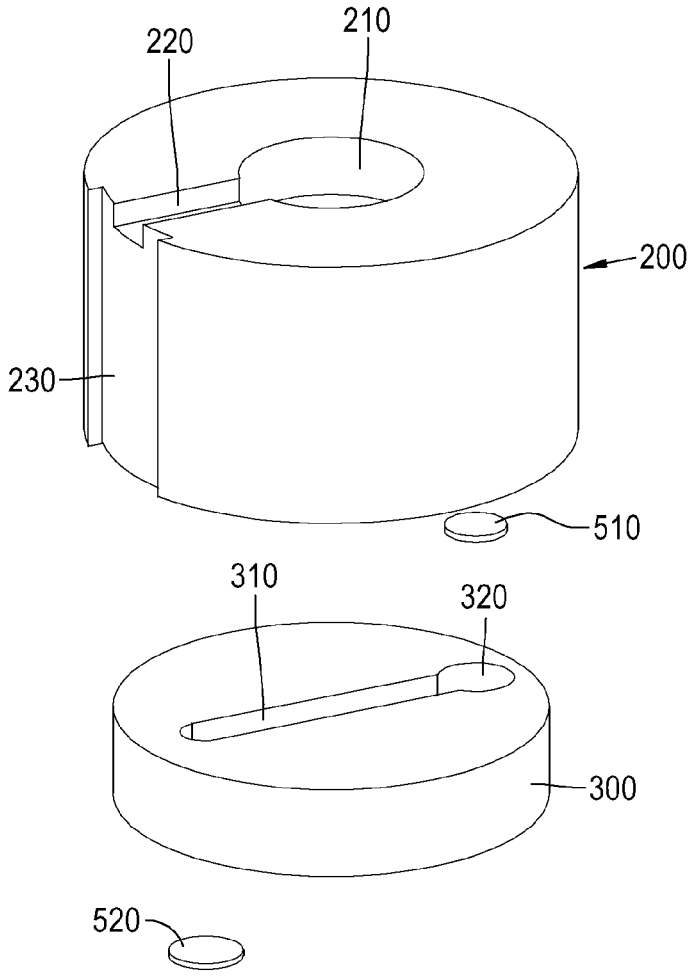
FIG. 3 is an exploded perspective view of a receiver unit having a pressure equilibrium structure and a compensation structure for low frequency according to an embodiment of the present invention.

FIG. 2 is a cross-sectional view of a receiver unit having a pressure equilibrium structure and a compensation structure for low frequency according to an embodiment of the present invention, and FIG. 3 is an exploded perspective view of a receiver unit having a pressure equilibrium structure and a compensation structure for low frequency according to an embodiment of the present invention.

A receiver unit having a receiver unit having a pressure equilibrium structure and a compensation structure for low frequency according to an embodiment of the present invention includes a receiver 100 and an upper casing 200 and a lower casing 300 covering the receiver 100.

The receiver 100, having a general form, includes a frame, a magnetic circuit including a yoke and a permanent magnet, a voice coil vibrated by mutual electromagnetic force with the magnetic circuit, and a diaphragm 110 provided with the voice coil and generating a sound by vibration. Here, for smooth vibration of the diaphragm 110, the receiver 100 includes a back hole 120 allowing air outside the receiver 100 to flow to the lower space of the diaphragm 110. The back hole 120 may be formed at a yoke or the frame according to a shape of the magnetic circuit structure or the frame of the receiver 100.

The upper casing 200 protects the receiver 100 and facilitates installation when installed in a housing 600 of an earphone. The upper casing 200 covers an upper portion of the receiver 100 and surrounds a side surface. The upper casing 200 is attached to the housing 600 by an adhesive 500 such as a double-sided tape. In an embodiment of the present invention, the receiver 100 is circular, so the upper casing 200 has a cylindrical shape. The housing 600 includes a sound tube 620 guiding sound into a user's ear and protruding to be inserted into the ear in case of a closed earphone. The upper casing 200 includes a sound insulation hole 210 corresponding to a position of the sound tube 620 so that a sound of the receiver 100 may be emitted to the sound tube 620.

Here, the upper casing 200 has ventilation recesses 220 and 230 provided on an outer surface thereof to allow a lower space of the receiver unit and the sound tube 620 to communicate with each other to improve user inconvenience such as occurrence of deafening of the ear or the like due to a difference in pressure between an ear canal and inside/outside of the earphone as the earphone completely seals the ear canal.

The ventilation recesses 220 and 230 include a first ventilation recess 220 extending from the sound insulation hole 210 to the side of the upper casing 200, i.e., to an outer circumference, in the radial direction and formed in a horizontal direction and a second ventilation recess 230 communicating with the first ventilation recess 220 and extending in a vertical direction to have an overall length of the side surface of the upper casing 200.

As air may flow from the sound tube 620 to the lower space of the receiver unit through the first ventilation recess 220 and the second ventilation recess 230, a change in pressure that may occur in the ear canal due to vibration of the diaphragm 110 of the receiver 100 may be buffered.

However, buffering the change in pressure formed at the diaphragm 110 by air flowing from the sound tube 620 to the lower space of the receiver unit inevitably decreases a sound pressure, and in particular, increases loss of sound pressure in a low frequency range.

In order to prevent this, a duct path 310 capable of improving low-frequency sound by generating resonance in the lower casing 300 is provided. Since the lower casing 300 is attached to the lower surface of the receiver 100 and an upper surface is closed by the receiver 100, the duct path 310 may be formed by forming a recess on the upper surface of the lower casing 300. An upper end of the duct path 310 communicates with the back hole 120 of the receiver 100 described above, and a lower end of the duct path 310 communicates with the lower space of the receiver unit in the earphone housing.

Meanwhile, in order to compensate for low frequency sound, the receiver unit may have an acoustic mesh. One or more acoustic meshes 510 and 520 may be provided in the duct path 310.

A first acoustic mesh 510 is attached to the receiver 100 to facilitate attachment and formed to cover the back hole 120. The duct path 310 includes a receiving recess 320 with an end having a diameter larger than that of the first acoustic mesh 510 to accommodate the first acoustic mesh 510.

The second acoustic mesh 520 is attached to the lower surface of the lower casing 300. The second acoustic mesh 520 is attached to cover the end of the duct path 310.

Figure 4:
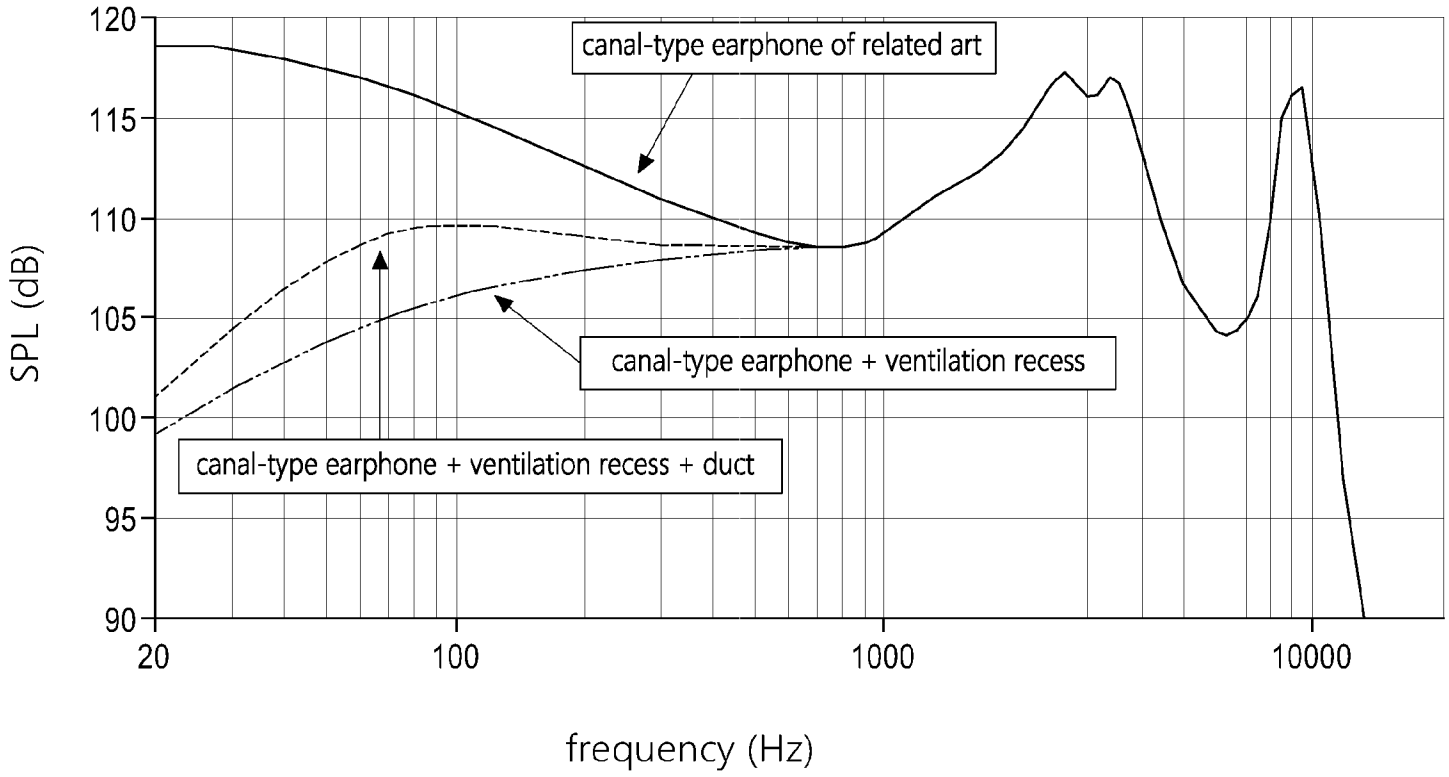
FIG. 4 is a graph showing comparison of sound pressure by frequency of a general canal-type earphone, a canal-type earphone having a receiver with a ventilation recess, and a canal-type earphone including a ventilation recess and a duct.

FIG. 4 is a graph showing comparison of sound pressure by frequency of a general canal-type earphone, a canal-type earphone having a receiver with a ventilation recess, and a canal-type earphone including a ventilation recess and a duct.

As can be seen from the graph, the canal-type earphone has a high SPL in the low frequency region, but if a ventilation recess is provided in order to relieve deafening of the ear, large loss occurs in the SPL in the low frequency region. In contrast, when the ventilation recess and the duct are provided together as in the present invention, the SPL loss occurring in the low frequency region may be compensated to some extent.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A receiver unit having a pressure equilibrium structure and a compensation structure for a low frequency, the receiver unit comprising:

a receiver including a frame, a magnetic circuit, a voice coil, and a diaphragm;

an upper casing covering an upper portion and a side surface of the receiver and having a sound insulation hole; and a lower casing attached to a lower surface of the receiver and coupled to the upper casing, wherein an upper surface of the lower casing is closed by the receiver, wherein a ventilation recess is provided on an outer surface of the upper casing to allow air to flow between an upper space of the upper casing and a lower space of the lower casing, wherein the receiver includes a back hole, wherein the lower casing includes a duct path formed by a recess on the upper surface of the lower casing for connecting the back hole and the lower space of the lower casing and for improving low frequency sound by generating resonance in the lower casing.

2. The receiver unit of claim 1, further comprising:

at least one acoustic mesh located in the duct path and compensating for a reduction in a low frequency.

3. The receiver unit of claim 2, wherein the acoustic mesh is attached to cover the back hole of the receiver.

4. The receiver unit of claim 2, wherein the acoustic mesh is attached to a lower surface of the lower casing to cover an end of the duct path.

5. The receiver unit of claim 1, wherein the ventilation recess is provided on at least one of an upper surface and a side surface of the upper casing.

* * * * *